US005751253A

United States Patent [19]

Wells

[11] Patent Number: 5,751,253

[45] Date of Patent: May 12, 1998

[54] ANTENNA COUPLING SYSTEM

[76] Inventor: Donald Horace Wells, 1011 Wentworth Ave., Holland, Ohio 43528

[21] Appl. No.: 526,180

[22] Filed: Sep. 11, 1995

[51] Int. Cl.[6] ..... H01Q 9/00

[52] U.S. Cl. ..... 343/749; 343/745; 343/861; 343/752

[58] Field of Search ..... 343/749, 750, 343/722, 723, 752, 856, 860, 864, 865, 850, 715, 861, 745; H01Q 9/00

[56] References Cited

U.S. PATENT DOCUMENTS

| | | | |
|---|---|---|---|
| 3,315,264 | 4/1967 | Brueckmann | 343/723 |
| 4,028,704 | 6/1977 | Blass | 343/715 |
| 4,080,604 | 3/1978 | Wosniewski | 343/750 |
| 4,764,773 | 8/1988 | Larsen et al. | 343/715 |
| 4,935,746 | 6/1990 | Wells | 343/715 |

*Primary Examiner*—Hoanganh T. Le
*Attorney, Agent, or Firm*—William P. Hickey

[57] ABSTRACT

A new and improved antenna-transmission line coupling system is provided wherein the electro-magnetic oscillations in the antenna are prevented from entering the circuitry which couples the antenna to its transmission line. The coupling structure (called coupler) includes an impedance matching transformer and a capacitor connected to the transformer and capacitively coupled with the antenna element. Various embodiments are provided for varying the capacitive coupling with the antenna element. Antenna elements having capacitor plates on their ends are disclosed; as well as an arrangement wherein a universal coupler having a broad band impedance matching transformer can be used with any number of antenna elements each tailored for a different commercial RF frequency band.

20 Claims, 6 Drawing Sheets

FIG. 1
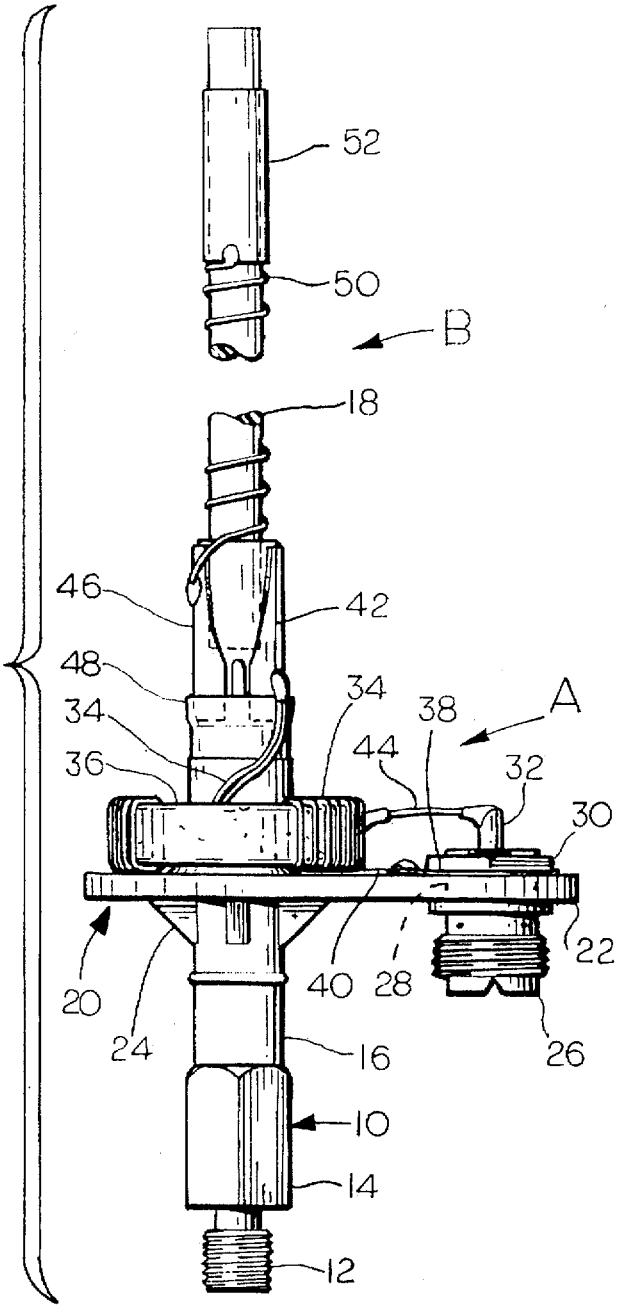
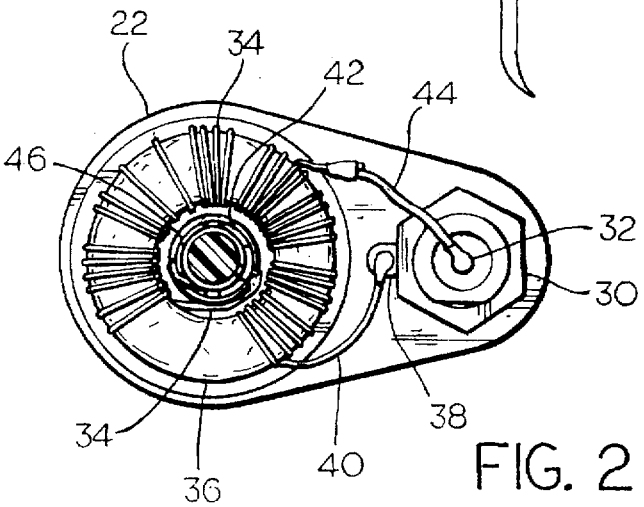
FIG. 2

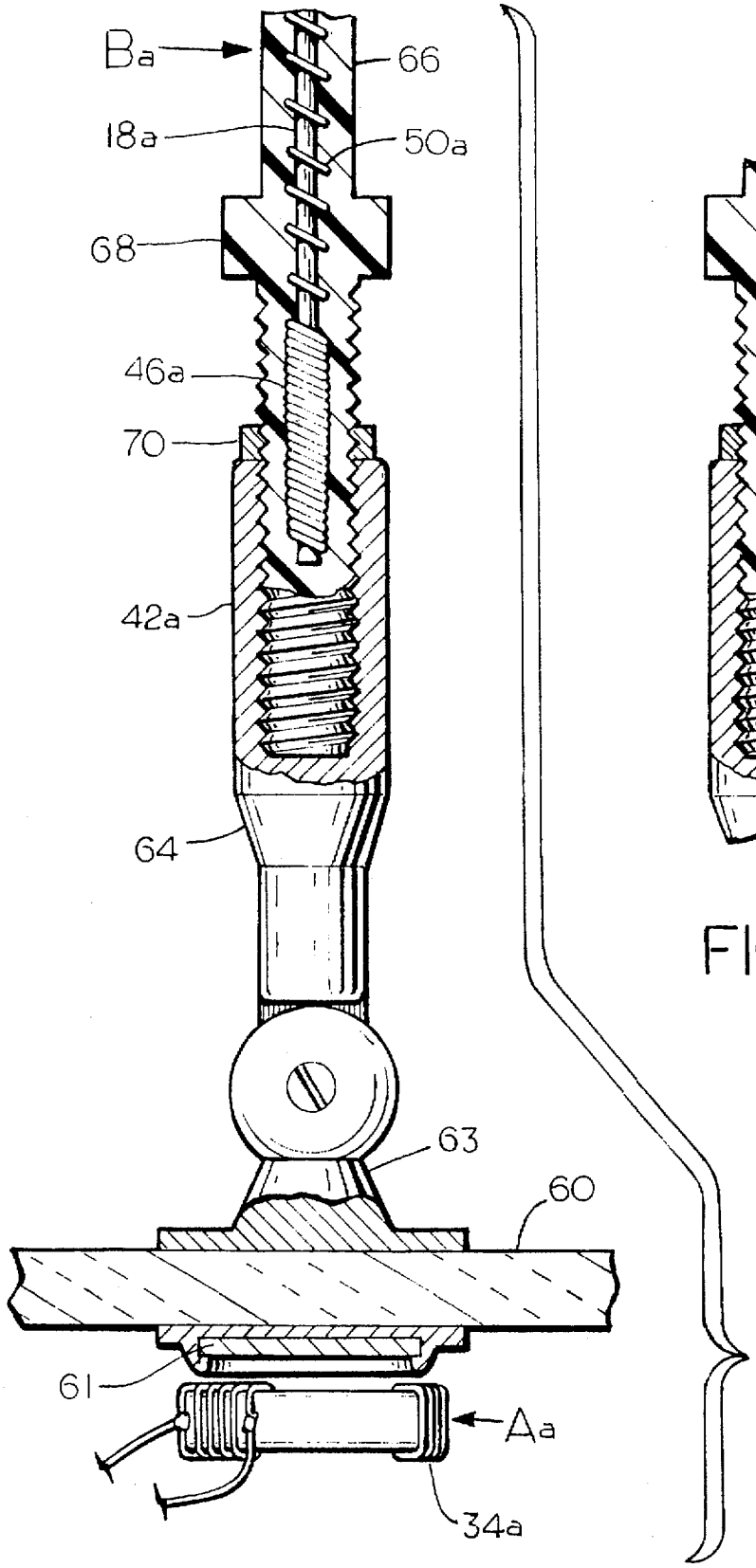
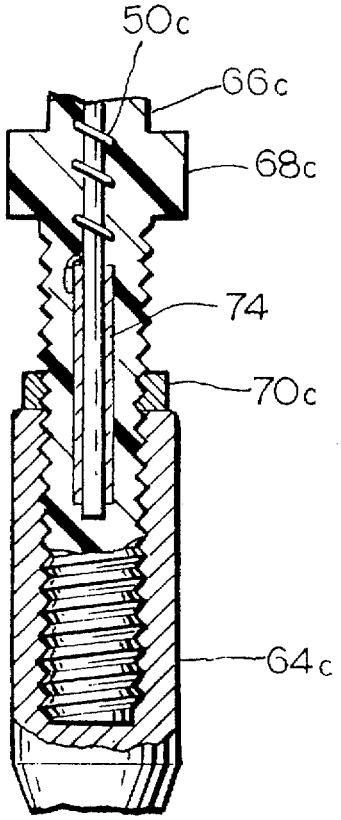
FIG. 7
FIG. 4

ANTENNA COUPLING SYSTEM

The present invention relates to an antenna-transmission line coupling system that is user tuneable, and which minimizes the transfer of antenna RF oscillations to the transmission line to which it is connected.

BACKGROUND

It is necessary for best efficiency to provide an impedance matching transformer between a transmission line and the antenna to which it is connected which will have an input of the same impedance as the transmission line, and an output that is the same as that of the point on the antenna to which it is connected. This is made more and more difficult as the width of the band pass increases. In all prior art systems with which I am familar a certain amount of antenna oscillations are reflected back into the transmission line to create standing waves therein which result in an inefficiency and a loss in power.

An object of the present invention is the provision of a new and improved antenna-transmission line coupling system wherein the impedance matching transformer is mounted as close as physically feasible to the antenna and wherein means are provided for tuning the system between the antenna and the transformer.

Another object of the invention is the provision of a new and improved system of the above described type that does not require a ground to be provided at the coupling system.

Another object of the invention is the provision of a new and improved antenna element which has capacitor plates at its opposite ends, and which arrangement accomplishes a number of highly desireable results, as will later be pointed out.

A still further object of the invention is the provision of a new and improved antenna-transmission line coupling system wherein the..antenna is separable from the transmission line coupler; and the transmission line coupler is capable of handling a band pass that encompasses a number of commercially established bands, so that the antennas designed to be efficient for the respective commercial bands can be used in conjunction with the coupler.

Further objects and advantages of the invention will become apparent to those skilled in the art to which the invention relates, from the following description of the preferred embodiments described with reference to the accompanying drawings forming part of this specification.

DESCRIPTION OF THE DRAWINGS

FIG. 1 is a side elevational view with the external covering removed and portions broken away of a first embodiment of the invention;

FIG. 2 is a cross sectional view taken approximately on the line 2—2 of FIG. 1;

FIG. 4 is a side elevational view with portions being sectioned to show the internal structure of a second embodiment of the invention;

FIG. 7 is a side elevational view, with portions being sectioned to show the internal structure, of a fourth embodiment of the invention;

DESCRIPTION OF THE PREFERRED EMBODIMENTS

The embodiment of the invention shown in FIGS. 1 through 3 comprises a unification in structure of a Transmission Line Impedance Matching Circuit A (which will hereinafter be called a Coupler), and an Antenna Element B for transforming transmission line signals to space radiation and vice versa. The matching circuit of Coupler A comprises a closed loop wound on a ferrite core. The loop has a length which provides a resistive input of the proper value and an output of high enough impedance to. match that of the Antenna Element B. The two conductors of the transmission line are connected to the closed loop at points spaced apart to match the impedance of the transmission line, and the Antenna Element B is connected to the closed loop at its impedance value. When the Element B is a voltage fed element, its connection will be at the end of the loop. This loop impedance matching circuit can be reduced in size when it is wrapped around a torroid of paramagnetic material.

Figure 3:
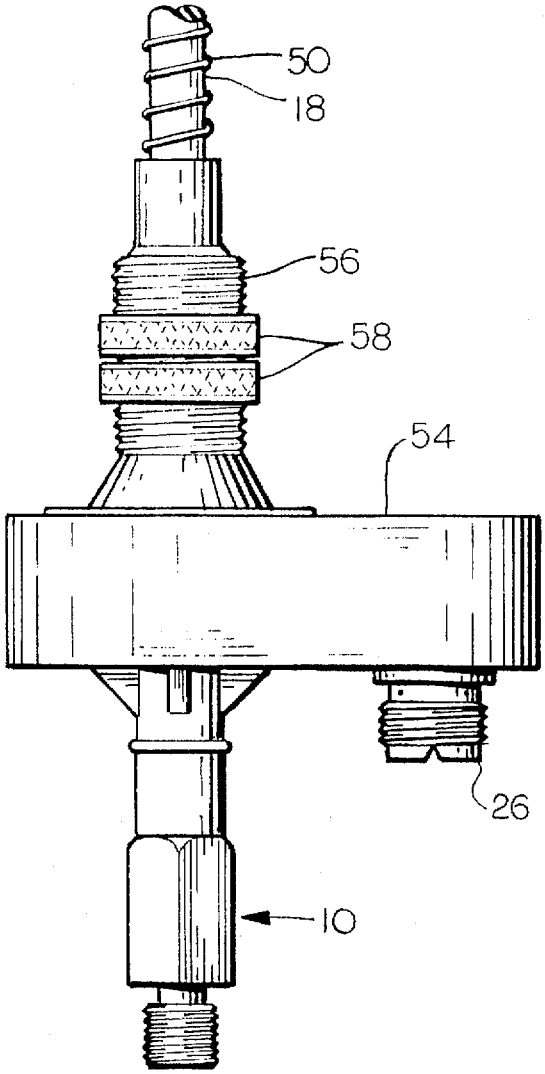
FIG. 3 is a side elevational view of the bottom section with cover in place of the embodiment shown in FIG. 1.

The integral impedance matching and radiation converting system shown in FIGS. 1 through 3, comprises a metallic automatic screw machine support 10, a fiber glass antenna rod 18, and an interconnecting injection molded body 20. The metallic support 10 has a reduced diameter threaded projection 12 on its lower end for attachment to conventional support structure. A hexagonal shank 14 is located just above that to provide a wrench engaging surface and above the shank 14 is a cylindrical projection 16 to which the body 20 is adhered.

The interconnecting body 20 has a platform 22 which is made rigid by triangularly shaped fillets 24 on the bottom thereof. The platform 22 extends horizontally a sufficient distance to receive a conventional metallic transmission line coupler 26 that extends through a suitable opening 28 in the platform and which is locked in place by the connector nut 30. The transmission line coupler 26 has a center pin 32 that is insulated from the body of the metallic coupler and which makes contact with the center conductor of the transmission line not shown. The other conductor of the transmission line makes contact with the metallic body of the coupler in conventional manner.

The Impedance Matching Circuit A comprises a bifilar conductor 34 wound around the torroid 36 of a paramagnetic material. The connector nut 30 is provided with a solding tab 38 that is soldered to a lead 40 that in turn is soldered to one end of the bifilar winding 34. The other end of the bifilar winding is connected to an antenna coupling capacitor plate 42. At a point on one of the bifilar windings which has the same impedance as the transmssion line (not shown) one end of a heavy conductor 44 is soldered and its other end is soldered to the center pin 32 of the transmission line coupler 26.

The capacitor plate 42 is generally triangularly shaped for reasons which will later be explained and it has a matching capacitor plate 46 positioned on the opposite side of the antenna rod 18. Both capacitor plates 42 and 46 have their narrow ends positioned -upwardly and both are held in place by a molded pocket 48. The capacitor plates 42 and 46 form the coupling capacitor for the transmission line to the Antenna Element B.

The Antenna Element B is a conductor 50 that is coiled around the antenna rod 18 and has one end soldered to the capacitor plate 46 and its upper end soldered to a capacitor plate 52. The conductor 50 and capacitor plates 52, 46 and to a relatively minor degree 42 provide an electrical length to the Antenna Element B that is approximately one half of the length of the transmitted frequency. A plastic cover 54 is provided with an externally threaded sleeve 56 which covers the capacitor plates 42 and 46 and a pair of internally threaded rings 58 are threaded onto the sleeve 56. The structure is completed by a shrink tube (not shown) that is pulled down over the antenna rod, and coiled conductor 50; and which has its lower end adhered over the upper end of the cover 54.

After installation in what ever environment the owner chooses, the rings 58 are positioned over as much of the triangularly shaped upper ends of the capacitor plates 42 and 46 as will give an adjusted capacitance coupling that will provide the precise frequency desired for the antenna. It has been found that when the capacitance provided by the capacitor plate 52 generally matches that of plates 42 , 46 and rings 58 that the maximum current in the conductor 50 will be approximately at the geometric center of the conductor 50. When this happens the radiation pattern will essentially be horizontal.

The embodiment of the invention shown in FIG. 4 of the drawings is that of a through the glass 27 MHz Band antenna. Those portion of FIG. 4 which correspond to portions of the embodiment shown in FIGS. 1–3 are designated by a like reference numeral characterized further in that a suffix "a" is affixed thereto.

In the embodiment shown in FIG. 4, the Impedance Matching Circuit Aa is adhered to one side of the glass 60 and contains a capacitor plate 61. A capacitor plate 62 is formed by the metal base 63 that is adhered to the other side of the glass 60. An internally threaded metal sleeve 64 is swivetably connected to the upper end of the metal base 63, and receives the lower end of the Antenna Element Ba the capacitor plate 42*a*.

The Antenna Element Ba has a fiber glass antenna rod 18*a* around which is wound the conductor 50*a*. The lower end of the conductor 50*a* is tightly coiled to form the capacitor plate 46*a*. A rod-shaped plastic body 66 is molded over the bottom end of the capacitor plate 46*a* and fiber glass rod 18*a*, and is externally threaded for engagement with the internally threaded sleeve 64. A hexagonally shaped wrench engaging portion 68 is provided for adjusting the position of the antenna rod relative to the sleeve 42*a* to adjust its capacitive coupling with the plate 46*a*. A suitable nut 70 is provided to lock the antenna in its adjusted position.

Figure 6:
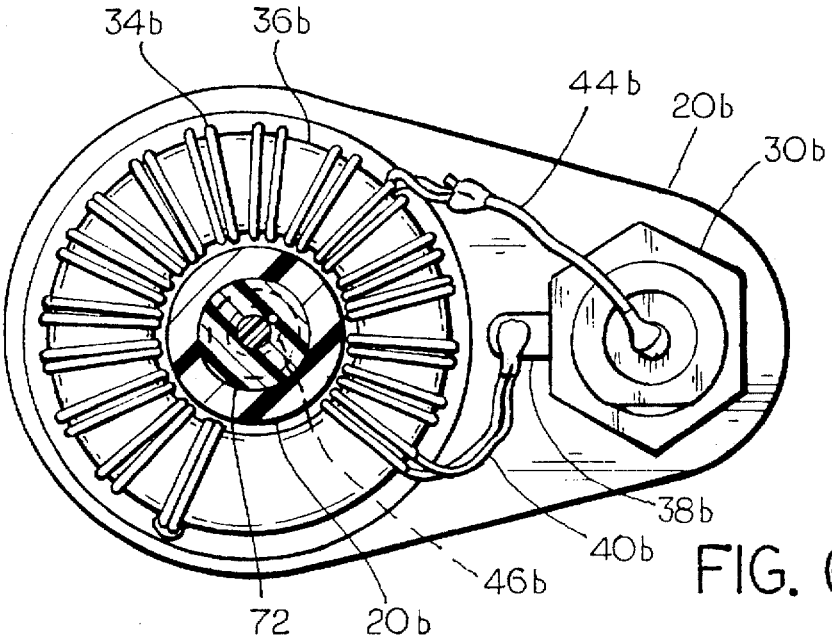
FIG. 6 is a cross sectional view taken approximately on the line 6—6 of FIG. 5.
Figure 5:
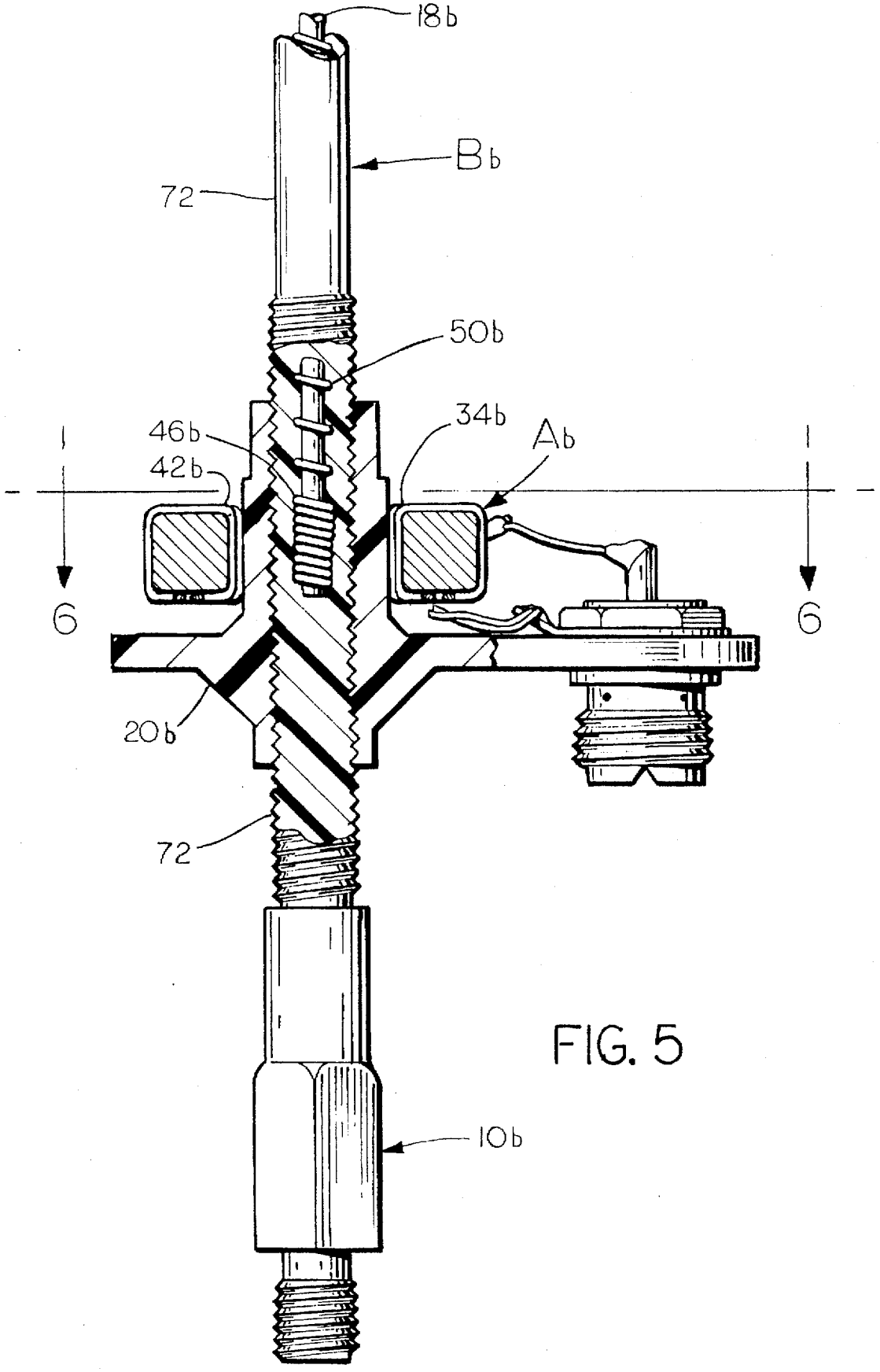
FIG. 5 is a side elevational view with portions being sectioned to show the internal structure of a third embodiment of the invention.

The embodiment shown in FIGS. 5 and 6 corresponds generally to that of the embodiment shown in FIGS. 1–3, but differs principally in that the capacitor coupling of its Antenna Element Bb is made directly with the bifilar windings 34*b* of its Impedance Matching Circuit Ab. Those portions of the embodiment shown in FIGS. 5 and 6 which correspond to portions of the embodiment shown in FIGS. 1–3 are designated by a like reference numeral characterized further in that a suffix "b" is affixed thereto.

In the embodiment shown in FIGS. 5 and 6, the upper end of the metallic support 10*b* is internally threaded to receive the lower end of an externally threaded rod 72 that is molded onto the lower end of the antenna rod 18*b* and conductor 50*b*. The bottom end of the conductor 50*b* is tightly coiled to provide the equivalence of capacitor plate 46*b*. The interconnecting body 20*b* is internally threaded to receive the threaded rod 72 and by adjusting the position of the antenna rod 18*b* with respect to the interconnecting body 20*b* an adjusted capacitance is provided between the capacitor plate 46*b* and the bifilar windings 34*b*. In this embodiment the bifilar windings serve as the capacitor plate 42*b*. A shrink tube (not shown) is pulled down over the conductor 50*b* and antenna rod 18*b* and is sealed to the upper end of the threaded rod 72.

The embodiment shown in FIG. 7 generally corresponds to that shown in FIG. 4 but differs principally in that the closely wound windings 46*a* of the embodiment shown in FIG. 4 are replaced by a metallic sleeve 74. Those portions of the embodiment shown in FIG. 7 which correspond to portions shown in FIG. 4 are designated by a like reference numeral characterized further in that a suffix "c" is affixed thereto.

It will be understood that the winding of the Impedance matching Circuit of the previously described embodiments need not be wound around a torroidally shaped core, but can be wound around a cylinder of paramagnetic material, or can utilize an air core.

Figure 8:
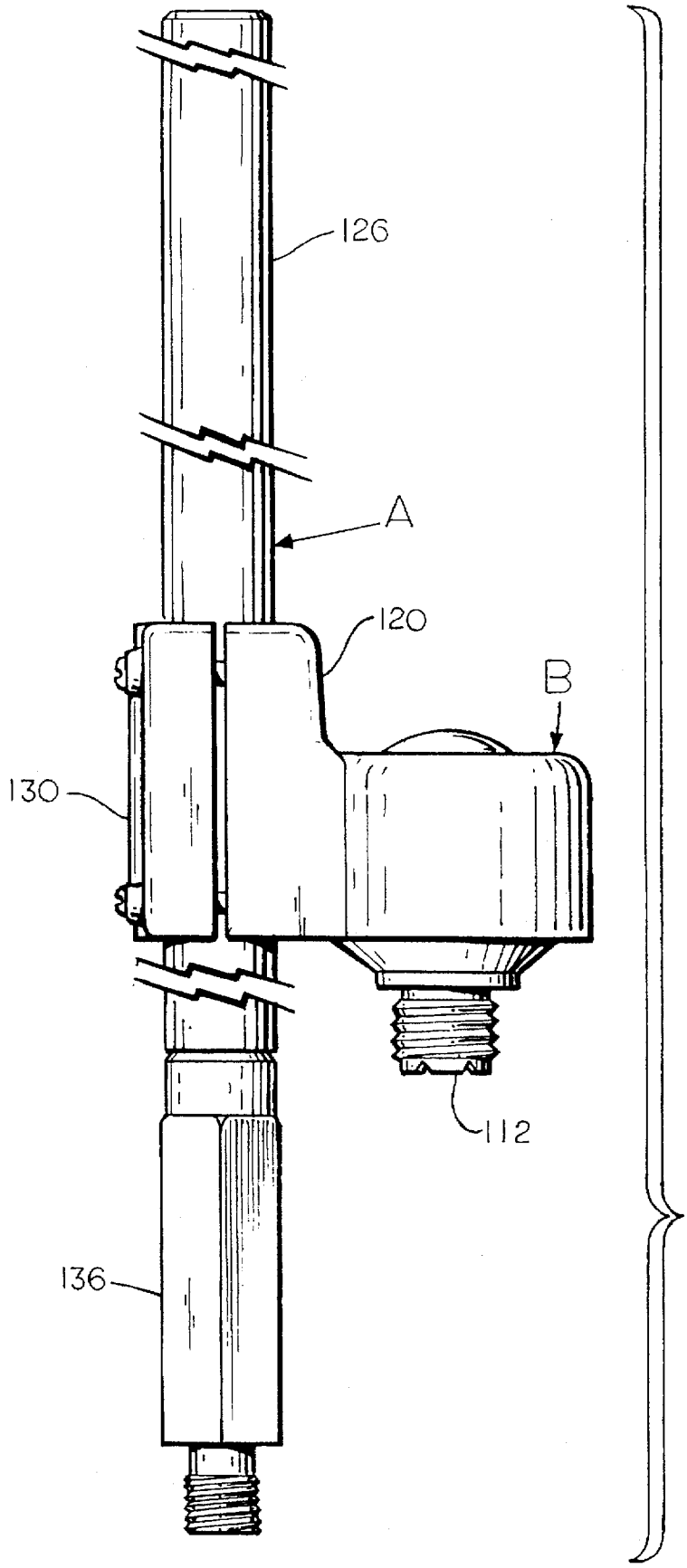
FIG. 8 is a side elevational view of another embodiment wherein the transmission line matching circuit is potted in a housing that is clamped to the side of the antenna.
Figure 10:
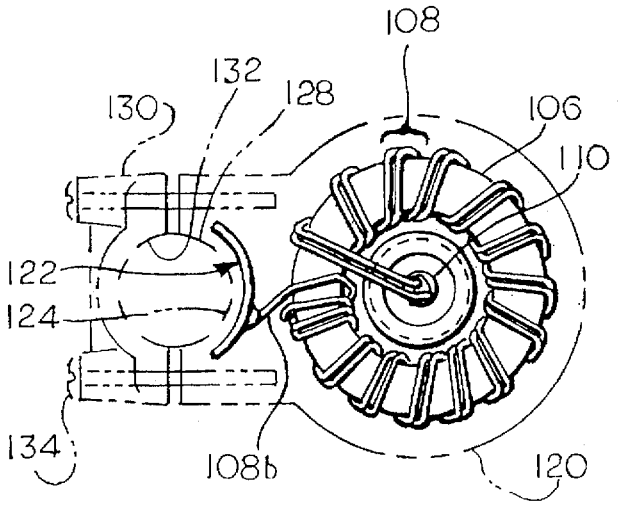
FIG. 10 is a plan view of FIG. 9.
Figure 9:
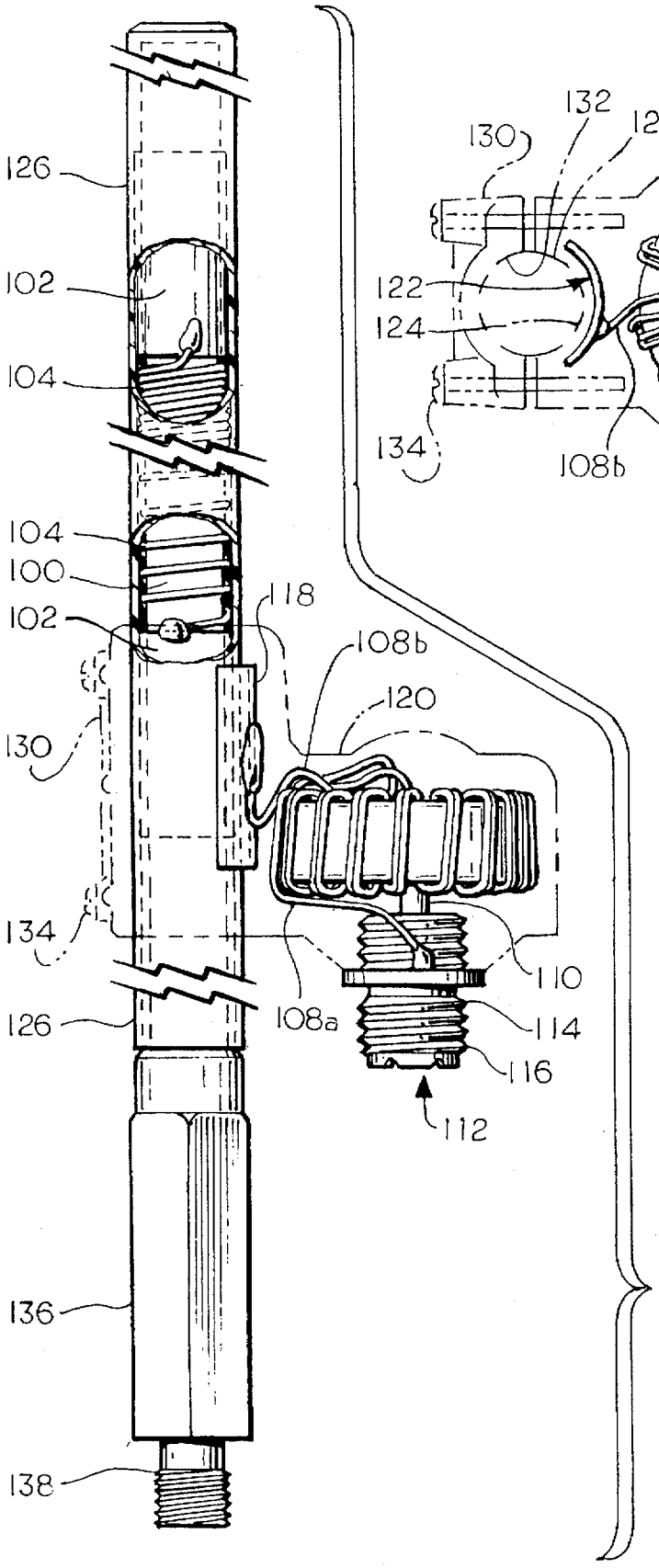
FIG. 9 is a side elevational view of the electrical components of the structure shown in FIG. 8, and with the outline of the housing shown in dot-dash lines.

The embodiment shown in FIGS. 8–10 comprises an antenna A and a Coupler B which are completely separate one from another, and are tuned by moving one transversely of the other. The antenna A comprises a fiberglass rod 100 having a pair of identical capacitor plates 102 respective ones of which are located adjacent opposite ends of the fiberglass rod. A conductor 104 is wound around the rod 100 with the opposite ends of the conductor 104 being soldered to a respective one of the capcitor plates 102. The length of the conductor 104 is chosen so that it with the capacitor plates 102 provides an electrical length that is slightly less than one half of that for a desired frequency. The Coupler B shown in FIGS. 8–10 comprises a torroid 106 of paramagnetic material around which is wound a bifilar winding 108. One end of the bifilar winding 108 is soldered to the center terminal 110 of a standard cable connector 112. The opposite end of one conductor 108*a* of the bifilar winding 108 is soldered to the body 114 of the connector 112 to which body the shielding of a transmission cable, not shown, is adapted to be connected through a nut that engages the threads 116 of the connector body 114. The adjacent end of the other wire 108*b* of the bifilar winding 108 is soldered to a capacitor plate 118 that is formed from a 120 degree segment of a cylinder. The wound torroid and capacitor plate are received in a housing 120 that surrounds the two; and holds the capacitor plate 118 in place. The housing covers the capacitor plate by a uniform thickness 122 to provide a hemicylindrical mating surface 124 to slidably receive the antenna A. The antenna A has a plastic covering 126 over the entire fiberglass rod, including the capacitor plates, which covering 126 provides a cylindrical mating surface 128 for engagement by the mating surface 124 of the housing 120. The mating surface 124 of the housing 120 parallels the mating surface 128 of the antenna A.

The Coupler A is completed by a clamping body 130 that in turn has a hemicylindrical surface 132 for gripping the side of the antenna element B opposite the mating surface 124 of the Coupler. Four self taping screws 134 pass through suitable holes in the clamping body 130 and are threaded into the housing 120 to clamp the housing onto the antenna A. The lower end of the antenna's fiberglass rod 100 is provided with a support ferrule 136, the lower end 138 of which is threaded for screwing into a threaded opening in a antenna mounting structure, not shown.

The bifilar winding 108 and torroid 106 of this embodiment are one form of a transmission line transformer. It is not necessary that the paramagnetic material around which the winding 108 is wound, be of a torroidal shaped. The paramagnetic material can be rod-shaped, or the winding 108 can have an air core with no paramagnetic material. Also there are many types of transmission line transformers, as for example trifilar wound, and quadrafiliar wound transmission line transformers, and all have the characteristic that the load is not carried by a magnetic field, but rather by the mutual transductance in the parallel windings. Also the transformer can be made by using a section of coaxial cable. All of the transmission line transformers of which I am aware have the capability of a very large band pass and further, they all isolate the current oscillations in their outputs from their inputs to keep any standing waves in the antenna out of their input from the transmission line.

The embodiment shown in FIGS. 8–10 utilizes the broad band pass capability of a transmission line transformer to create a system wherein one design of Coupler B can be used to couple with a whole series of antennas A, each one of the series of which is designed to handle a different band of RF frequencies. As for example one Coupler B can drive antennas each of which are designed for a different band as for example the 10 meter, 11 meter, 20 meter, 40 meter bands, etc.

The design of antenna A shown in FIGS. 8–10 allows one length of antenna to be made for 10 meters, another for 20 meters, etc. but all will couple with the Coupler B and be capable of being tuned by moving the Coupler B longitudinally of the antenna that is received in its mating surface until the oscillations in the antenna generally terminate in the capacitor plates at its opposite ends. Antennas having equal capacitor plates at opposite ends are believed novel and have essentially a true horizontal radiation pattern.

It will now be seen that the objects heretofore enumerated as well as others have been accomplished and that there has been provided an antenna-transmission line coupling system of improved efficiency, and which can be easily tuned by the user by adjusting a coupling capacitor at the antenna itself.

In one preferred embodiment, applicant accomplishes the above object by a capacitive ring whose position is adjusted relative to an end capacitor plate. In other embodiments, applicant accomplishes the above by adjusting the position of the end capacitor plate relative to the capacitor plate which couples with the transmission line. By so adjusting the coupling, antenna oscillations are kept out of the impedance matching transformer, and the transmission line. Further, no grounding adjacent the antenna is required.

It will also be seen that applicant has provided antenna Radiation Converting Elements of improved efficiency by having generally matching capacitor plates on opposite ends of the Radiation Converting Element.

It will also be seen that there has been provided an arrangement for making the point of maximum current flow in an antenna occur at the physical center of the antenna by using matching capacitors on opposite ends of the Radiation Converting Element.

It will further be seen that applicant has provided a transmission line coupling device wherein its coupling with an antenna is essentially independent of frequency so that a whole series of antennas individually tuned to different frequencies can be driven by the same transmission line coupling device.

While the invention has been described in considerable detail, I do not wish to be limited to the embodiments shown and described, and it is my invention to cover hereby all novel adaptations, modification and arrangements thereof which come within the practice of those skilled in the art and which come within the purview of the following claims.

I claim:

1. An antenna-transmission line coupling system comprising: a wound inductance producing antenna element, a first capacitance element series connected to a first end of said antenna element, a second capacitance element series connected to the opposite end of said antenna element, said antenna element and capacitance elements having an electrical wave length that is approximately one half that having a desired frequency, a third capacitance element capacitively coupled with said first capacitance element, and a transmission line transformer having an input and an output with said output being connected to said third capacitance element.

2. The system of claim 1 wherein said first and second capacitance elements of said antenna element are constructed and arranged to cause maximum current flow in said antenna element to occur approximately midway between the opposite ends of said antenna element.

3. The system of claim 1 wherein said transformer is of a type which effectively decouples antenna currents from transmission line currents.

4. An antenna-transmission line coupling system comprising: a half wave length antenna element, a first capacitor plate fixed to one end thereof, and a housing having a uniform mating surface extending over and parallel to said first capacitor plate, said capacitor plate being constructed and arranged to bring said antenna element to its desired frequency when tuned; and an antenna-transmission line coupler having a housing with a mating surface parallel to and matching that of said antenna element, said coupler having a capacitor plate adjacent said mating surface of said coupler and being arranged to provide capacitive coupling with that of said antenna element; said mating surfaces accomodating relative parallel movement to bring differing amounts of said capacitor plates opposite one another; and means for fixing said mating surfaces together through out said parallel movement.

5. The system of clam 4 wherein said antenna element includes a second capacitor plate adjacent the end of the antenna element opposite of said first capacitor plate, and whereby the antenna oscillates between said first and second capacitor plates.

6. An antenna-transmission line coupler for an antenna element having a uniform mating surface, and comprising: a housing having a uniform mating surface which parallels the uniform mating surface of the antenna element when juxtaposed to accommodate parallel movement there between; a capacitance element in said housing adjacent its uniform mating surface; and a transformer in said housing having a transmission line input, and an output connected to said capacitance element; and means for accomodating adjustment movement of said housing parallel to the mating surface of the antenna element, and for fixing said coupler to an antenna element when it is in an adjusted position in said mating surface of said housing.

7. The coupler of claim 6 wherein said transformer is a transmission line transformer of a type which effectively decouples its output current from the transmission line currents.

8. The coupler of claim 7 wherein said housing surrounds and hermetically seals said capacitance element and transformer.

9. A longitudinally extending antenna element having an electrical length less than that which provides a one half wave length of a desired tuned frequency, and including a first capacitance plate adjacent one end of the antenna element; and a covering over and hermetically sealing said capacitance plate, said covering having a uniform mating surface for abutment by a coupler, said uniform surface of said covering extending longitudinally over said capacitance plate by a distance which allows operative capacitive coupling with the coupler over a range of longitudinal positions to vary the capacitance of said capacitance plate, and by the positioning of which said antenna element is tuned.

10. The antenna element of claim 9 including a second capacitance plate adjacent the end of said antenna element opposite its first end, and between which capacitance plates the tuned signal of said element oscillates.

11. The antenna of claim 10 wherein the capacitance of said first and second capacitance plates is essentially equal so that maximum current flow in said element occurs approximately midway between opposite ends of said element.

12. A combination antenna and transmission line coupling device, comprising: a torroid of paramagnetic material; an axially extending support rod extending through said torroid: a first capacitor plate on said support rod; an antenna winding having one end connected to said first capacitor plate; a second capacitor plate on said support rod and having capacitive coupling with said first capacitor plate; a transformer winding on said torroid, said transformer winding having an input for a transmission line and an output connected to said second capacitor plate; and a third capacitor plate movable relative to said first and second capacitor plates for adjusting the capacitive coupling between said first and second capacitor plates.

13. The device of claim 12 wherein said first and second capacitor plates are mounted generally on opposite sides of said support rod, and said third capacitor plate is a ring mounted for axial movement on said rod relative to said first and second capacitor plates.

14. A combination antenna and through the glass transmission line coupling device, comprising: a core of paramagnetic material; a transformer winding around said core and having input and output connections for a transmission line; a first capacitor plate in the electrical field of said transformer winding and adapted to be positioned against one side of a generally flat insulator; a second capacitor plate adapted to be positioned against the opposite side of the insulator; a tubular sleeve fixed to said second capacitor plate, said sleeve having an opening which extends away from said second capacitor plate and which has female threads therein; an antenna rod having a third capacitor plate on one end and which is adapted to fit in said opening of said sleeve; an insulating jacket on said antenna rod covering said third capacitor plate, said jacket having male threads received by said female threads of said sleeve; and whereby said third capacitor plate can be moved in and out of said sleeve to tune said antenna.

15. A combination antenna and transmission line coupling device, comprising: a torroid of paramagnetic material; a support for said torroid, said support having a tubular portion extending through said torroid, said tubular portion being of an insulating material and having female threads therein; a transformer winding on said torroid creating an electrical field, said winding having an input and an output for connection to a transmission line; an antenna support rod of insulating material and having male threads which engage said female threads of said torroid support; and an electrically conductive antenna element having a capacitor plate inside said insulating material of said support rod; and whereby said antenna support rod can be threaded along said torroid support to move said capacitor plate in and out of the electrical field of said torroid.

16. A system for coupling an antenna to a transmission line having a characteristic impedance, said system comprising: an antenna monopole comprising a first capacitor plate in series with an inductance with the combination having an electrical length approximately one half wave length that of a desired frequency; a second capacitor plate coupling with said first capacitor plate; first and second transmission line terminals; and filar conductor windings connecting said first and second transmission line terminals and said second capacitor plate, said filar windings being constructed and arranged to provide maximum transmission line voltage at said second capacitor plate.

17. The antenna transmission line coupling system of claim 16 wherein: said filar conductor windings are bifilar windings one end of which are connected to said second capacitor plate, and the other end of said bifilar windings are connected to said first transmission line terminal, said second transmission line terminal being connected to one of said bifilar windings at a point adjacent said second terminal and having the characteristic impedance of the transmission line.

18. A system for capacitively coupling a transmission line to an antenna, comprising: an antenna rod structure, and a coupler structure, said structures having parallel mating abutment surfaces with parallel capacitance elates beneath their abutment surfaces, said coupler structure having a transmission line transformer connected to its capacitance plate and hermetically sealed therein, said mating abutment surfaces being constructed to accommodate parallel movement relative to each other to vary their capacitive coupling, and means for clamping said antenna rod and coupler structures together.

19. The system of claim 18 wherein said transformer is of a type which effectively decouples antenna currents from transmission line currents.

20. An antenna monopole for radiation of a desired frequency, and comprising: first and second spaced apart capacitor plates having approximately the same surface area; a coiled conductor connecting said first and second spaced apart capacitor plates; said coiled conductor having an impedance which in series with said first and second capacitor plates has an electrical length approximately one half wave length that of said desired frequency; and whereby said monopole has an H-field that is centered between said capacitor plates.

* * * * *